US006722846B2

(12) United States Patent
Burdgick

(10) Patent No.: US 6,722,846 B2
(45) Date of Patent: Apr. 20, 2004

(54) ENDFACE GAP SEALING OF STEAM TURBINE BUCKET TIP STATIC SEAL SEGMENTS AND RETROFITTING THEREOF

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/207,385

(22) Filed: Jul. 30, 2002

(65) Prior Publication Data

US 2004/0022626 A1 Feb. 5, 2004

(51) Int. Cl.[7] ..... F01D 11/08
(52) U.S. Cl. ..... 415/173.5; 415/139
(58) Field of Search ..... 415/173.5, 139, 415/174.5, 170.1; 29/888, 888.3

(56) References Cited

U.S. PATENT DOCUMENTS 5,049,032 A * 9/1991 Brandon ..... 415/170.1
5,395,124 A * 3/1995 Brandon ..... 277/53
5,487,549 A * 1/1996 Dalton et al. ..... 277/54
5,624,227 A 4/1997 Farrell
5,810,365 A * 9/1998 Brandon et al. ..... 277/146
5,934,687 A 8/1999 Bagepalli et al.
5,971,400 A * 10/1999 Turnquist et al. ..... 277/416
6,027,121 A * 2/2000 Cromer et al. ..... 277/347
6,045,134 A * 4/2000 Turnquist et al. ..... 277/347
6,286,211 B1 * 9/2001 Turnquist et al. ..... 29/888.3
6,308,958 B1 * 10/2001 Turnquist et al. ..... 277/355
6,550,777 B2 * 4/2003 Turnquist et al. ..... 277/355

* cited by examiner

*Primary Examiner*—Edward K. Look
*Assistant Examiner*—J. M. McAleenan
(74) *Attorney, Agent, or Firm*—Nixon & Vanderhye

(57) ABSTRACT

Spline seals are disposed in circumferentially registering slots of adjacent arcuate seal strip segments disposed in grooves of diaphragm assemblies of a steam turbine in radial opposition to the rotating tips of the buckets. The spline seals extend in the gaps between the endfaces of the segments and minimize or preclude steam leakage past the endfaces. The spline seals are disposed in slots which may be formed as part of original equipment manufacture or may be machined in segments with the spline seals provided as retrofits.

19 Claims, 3 Drawing Sheets

ENDFACE GAP SEALING OF STEAM TURBINE BUCKET TIP STATIC SEAL SEGMENTS AND RETROFITTING THEREOF

BACKGROUND OF THE INVENTION

The present invention relates generally to seals between circumferentially registering endfaces of bucket tip static seal segments in steam turbine diaphragm assemblies and particularly relates to spline seals between endfaces of bucket tip static seal segments circumferentially disposed end to end in a stationary diaphragm of the steam turbine and methods of retrofitting the splined seals.

In steam turbine design, it is highly desirable to minimize or eliminate as many steam leakage paths as possible within the steam flowpath. Each stage of a steam turbine includes a plurality of circumferentially spaced buckets mounted on a rotor and a diaphragm carrying a plurality of nozzles, the buckets and nozzles forming a stage of a turbine section of the steam turbine. Mounted in the diaphragm assembly is a static seal typically known as a seal strip for sealing with the tips of the rotating buckets. The seal strip is typically placed or rolled into a circumferential slot in the diaphragm or shell of the steam turbine. The seal strip is annular in configuration and formed of a number of arcuate seal strip segments. The segments are installed in the diaphragm assembly or shell to form an annular array thereof, i.e. a continuous annular ring that forms a seal with the bucket tips between high and lower pressure regions on opposite sides of the turbine stage.

The static seal strip segments are located directly about the rotating bucket tips and control any leakage over the bucket tips which is crucial to machine performance. The static seal strip segments are typically located in circumferential slots and dovetail-shaped grooves formed about the diaphragm assembly. The gap between endfaces of the arcuate seal strip segments however presents a significant leakage path for the steam. If sufficiently large, this leakage path may cause significant losses in efficiency which translate into loss of potential revenue for the user of the steam turbine, typically an electrical power producer. The gap between the endfaces of the seal strip segments can be quite large because of machine tolerances of the segments and diaphragm or turbine shell. Further, the gap between adjacent endfaces may also increase during operating conditions due to thermal growth differences and pressure forces between the diaphragm and shell. Moreover, the leakage can be quite significant in view of the fact that the seal strip segments are deployed in each of the high, intermediate and low pressure sections of a typical steam turbine unit. Consequently, there is a need for endface gap seals for the static seal strip segments sealing between the diaphragm or shell and the rotating bucket tips in a steam turbine.

BRIEF DESCRIPTION OF THE INVENTION

In a preferred embodiment of the present invention, there is provided spline seals on the opposing endfaces of static seal strip segments for sealing between those endfaces and minimizing or eliminating steam leakage flow between high and low pressure regions on opposite sides of the turbine buckets. Particularly, slots are formed in the endfaces of the seal strip segments and spline seals are inserted into the slots to seal across any gaps appearing between the endfaces. The seal strip segments are disposed in annular grooves formed in the diaphragm assemblies. Certain of the grooves are in a dovetail-shaped configuration with the seal strip segments having a generally complementary configuration. Additionally, the spline seals may extend in generally axial or radial directions. The spline seals in axial directions extend substantially the full axial width of the seal strip segment to preclude steam leakage flow in a radial outward and then axially downstream direction past any gap between the endfaces of adjacent seal strip segments. The radially extending spline seals extend substantially the full radius of the seal strip segment to preclude or minimize steam leakage flow in an axial direction through any gap between the endfaces of the seal strip segments.

In a preferred embodiment according to the present invention, there is provided a steam turbine comprising a rotor carrying a plurality of circumferentially spaced buckets having bucket tips, a stationary casing surrounding the rotor and carrying a plurality of nozzles, the buckets and nozzles forming a stage of the steam turbine, the casing carrying a plurality of circumferentially extending static seal strip segments thereabout at an axial seal location spaced radially from the bucket tips for sealing between the bucket tips and the casing, each of the segments having endfaces respectively in circumferential registry with opposed endfaces of circumferentially adjacent segments, the endfaces including slots opening circumferentially and in general circumferential registration with one another and a spline seal extending between each of the opposed endfaces of circumferentially adjacent segments and in the slots for minimizing or precluding steam leakage flow past the registering endfaces.

In a preferred embodiment according to the present invention, there is provided a steam turbine comprising a rotor carrying a plurality of circumferentially spaced buckets having bucket tips, a stationary casing surrounding the rotor carrying a plurality of nozzles, the buckets and nozzles forming a stage of the steam turbine, the casing having a circumferentially extending dovetail-shaped groove carrying a plurality of circumferentially extending static seal strip segments thereabout in the groove, the segments carrying at least one labyrinth seal tooth for sealing about the bucket tips, each of the segments having endfaces respectively in circumferential registry with opposed endfaces of circumferentially adjacent segments, the endfaces including slots opening circumferentially and generally in circumferential registration with one another and a spline seal extending between each of the opposed endfaces of circumferentially adjacent segments and in the slots for minimizing or precluding steam leakage flow past the registering endfaces.

In a further preferred embodiment according to the present invention, there is provided in a steam turbine having a rotor carrying a plurality of circumferentially spaced buckets, a stationary casing surrounding the rotor and a plurality of circumferentially extending seal strip segments in circumferentially extending grooves about the casing for sealing between the casing and tips of the buckets, a method of retrofitting the seal strip segments to provide seals between the opposed endfaces of adjacent seal strip segments comprising the steps of removing the seal strip segments from the turbine casing, forming at least one slot in each endface of the removed seal strip segments, disposing a spline seal in slots of opposed endfaces of the seal strip segments and inserting the seal strip segments into the grooves of the casing whereby the spline seals extend between adjacent segments for minimizing or precluding steam leakage flows between the adjacent segments.

DETAILED DESCRIPTION OF THE INVENTION

Figure 1:
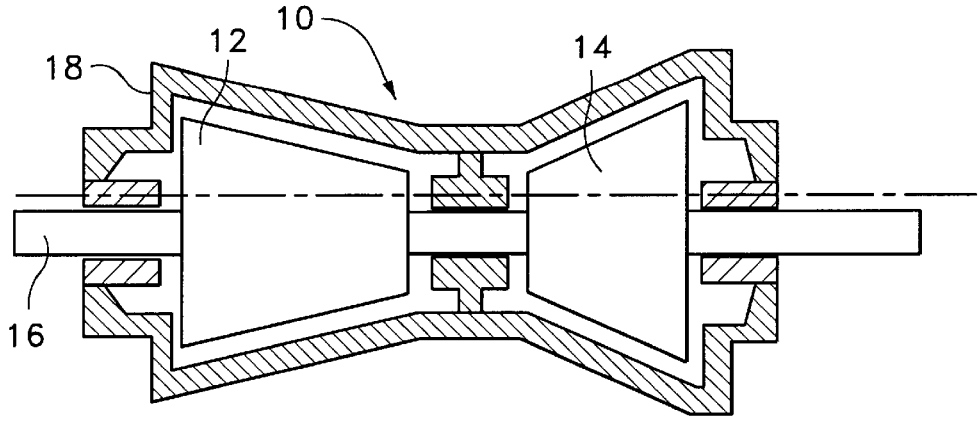
FIG. 1 is a schematic illustration of a steam turbine having high and intermediate pressure turbine sections.
Figure 2:
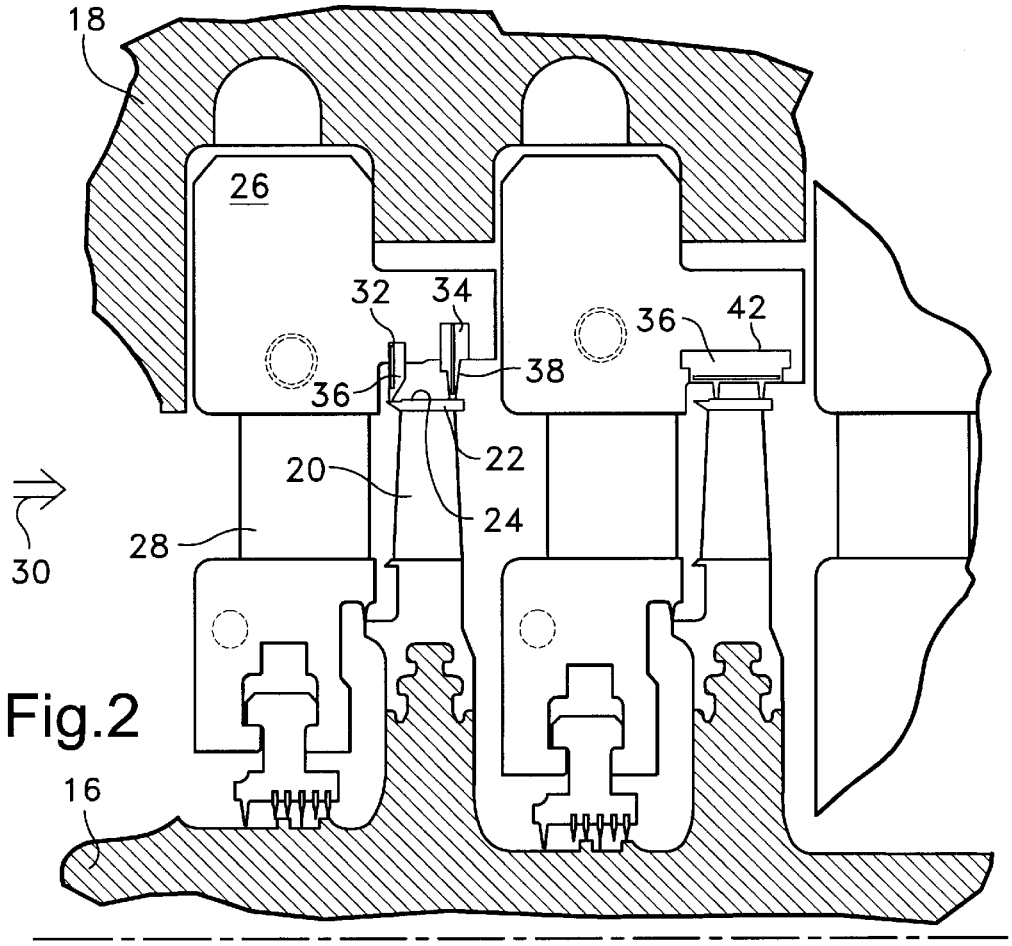
FIG. 2 is a fragmentary enlarged partial cross-sectional view through the rotor and diaphragm assembly illustrating the locations of the bucket tip static seal strip segments in the diaphragm assembly according to a preferred form of the present invention.

Referring now to the drawings, particularly FIG. 1, there is illustrated a steam turbine, generally designated 10. Steam turbine 10, in this example, is comprised of a high pressure turbine section 12 and an intermediate pressure turbine section 14 mounted on a single integral rotor 16 extending beyond opposite ends of a steam turbine casing 18. It will be appreciated that the rotor 16 is driven in rotation by the high and intermediate pressure turbine sections 12 and 14, while the casing 18 remains stationary. As typical in steam turbines and referring to FIG. 2, the rotor 16 mounts a plurality of circumferentially spaced buckets 20 typically having cover plates 22 at their tips 24. Each turbine section also includes a diaphragm assembly 26 mounting a plurality of nozzles 28, i.e., stator vanes. Axially adjacent buckets 20 and nozzles 28 form a stage of the steam turbine 10 and it will be appreciated that two stages are illustrated in FIG. 2, although any number of additional stages are typical. The steam flow path past the nozzles 28 and buckets 20 is indicated by the steam flow direction arrow 30.

Figure 3:
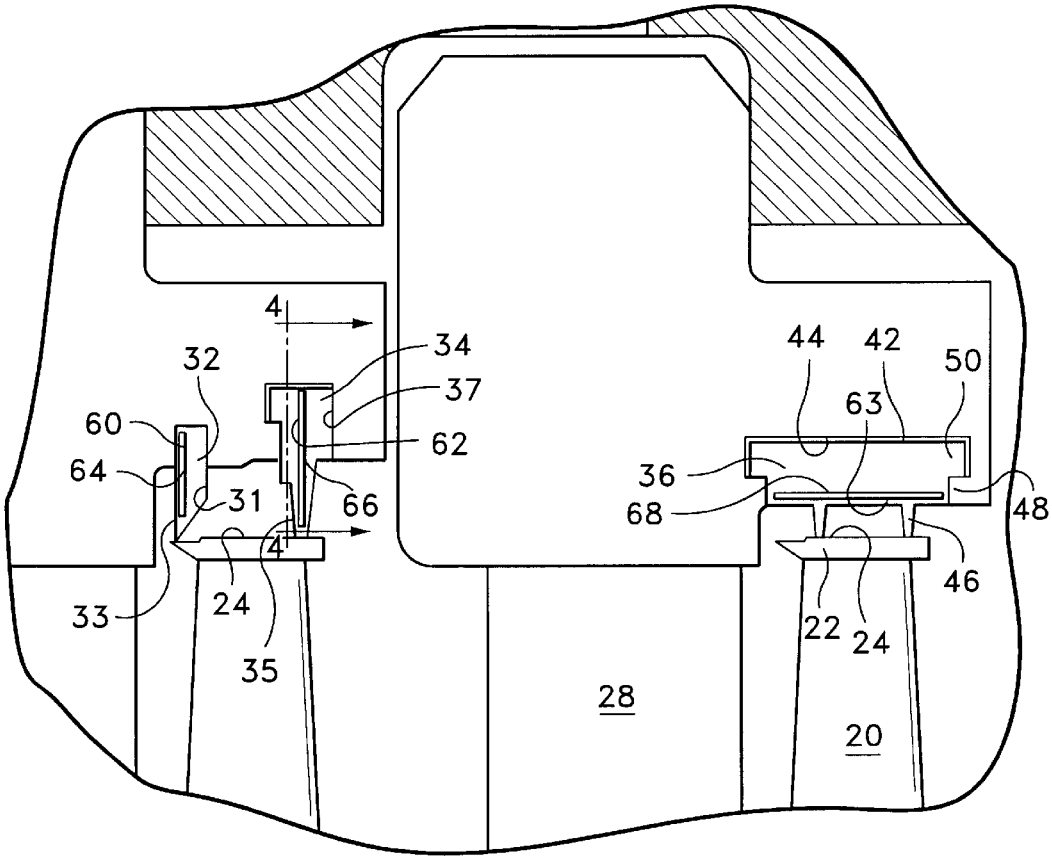
FIG. 3 is a fragmentary enlarged illustration of the static seal strip segment endfaces overlying tips of the rotating buckets.

Seal strips 32, 34 and 36 are mounted in the diaphragm assemblies 26 at respective axial locations in radial opposition to the tips 24 including the covers 22 of the buckets 20 for sealing steam flow leakage about the tips 24. In the left hand stage illustrated in FIG. 2, the seal strips 32 and 34 each comprise a plurality of arcuate seal strip segments 36 and 38, respectively, having radially inwardly directed seal teeth 33, 35, respectively, forming labyrinth seal teeth with the tips 24 of the buckets 20. Seal strip segment 32 is disposed in a groove 31 of the diaphragm assembly. Seal strip segment 34 resides in a dovetail-shaped groove 37 in the diaphragm assembly with segment 34 being complementary in shape to the groove 37. In the second or right hand stage, the seal strip comprises a plurality of arcuate seal strip segments 42 disposed in a dovetail-shaped groove 44 formed in the diaphragm assembly. Each arcuate seal strip segment 36 includes one or more labyrinth teeth 46 projecting radially inwardly from the segment for sealing with the tip of the buckets 20. For example, each of the diaphragm assemblies is conventionally provided in an upper and lower diaphragm half and each half of the diaphragm assembly may mount a plurality of bucket tip seal segments for example three segments in each of the upper and lower halves. As illustrated in FIG. 3, the seal strip segments 36 are mounted in the dovetail-shaped groove 44 which includes a pair of axially opposed hooks 48. The seal strip segments 36 have axially extending hooks 50 lying radially outwardly of hooks 48 for retaining the seal segments in the grooves 44. It will be appreciated, however, that any number of seal strip segments 36 may be disposed in each of the diaphragm halves.

With the arrangement of the arcuate seal strip segments 32, 34 and 36 in the respective grooves, it will be appreciated that gaps will appear between the endfaces of the adjoining segments. For example, as illustrated in FIG. 3, there is a gap 54 which appears between the endfaces 56 of adjoining bucket tip seal strip segments 36. As indicated previously, manufacturing and machining tolerances do not permit accurate sealing faces between the adjoining seal strip segments and thus steam leakage paths are typically prevalent between the endfaces of adjoining segments.

Figure 4:
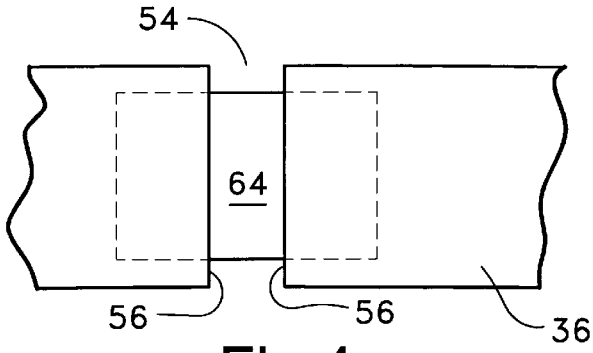
FIG. 4 is an enlarged cross-sectional view taken generally about on line 4—4 in FIG. 3.

In accordance with the preferred embodiment of the present invention, spline seals are disposed between the circumferentially registering endfaces of the adjacent seal strip segments 36. For example, and referring to FIGS. 3 and 4, grooves or slots are disposed in each of the adjoining endfaces of the adjoining segments 32, 34 and 36. With respect to the adjoining endfaces of segments 32 and 34, the slots 60 and 62, respectively, extend in a generally radial direction whereas with respect to the segments 36, the slots 63 extend in an axial direction. In all cases, the slots extend a limited distance in a circumferential direction. The slots 60, 62 and 63 of the respective segments 32, 34 and 36 register one with the other and receive spline seals to span the gaps between the endfaces. For example, the seal strip segments 32 have spline seals 64 extending in a generally circumferential direction in the registering radial slots 60 of the adjoining segments 32. The segments 34 have spline seals 66 disposed in the registering slots 62 of the endfaces of adjoining segments 34. Similarly, the adjoining endfaces of seal strip segment 36 have spline seals 68 in the registering endface slots 63.

Figure 5:
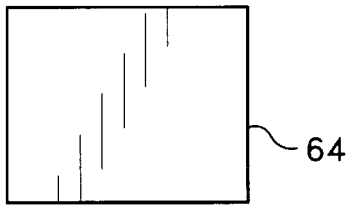
FIG. 5 is a plan view of a spline seal.

Each spline seal may comprise a flat metal plate as illustrated in FIG. 5, which is of a generally rectilinear shape. The thickness of the plate is less than the depth of the slots to accommodate relative movement of the segment, e.g. caused by thermal transients in the machine. From a review of FIG. 3 it will be appreciated that the spline seals 64 and 66 each extend in a generally radial direction along the majority of the radial extent of the segments 32 and 34 respectively. The spline seal 68 extends in an axial and circumferential direction in the registering opposing slots 63 in the endfaces of the adjoining seal strip segments 36. As a consequence of these arrangements, steam leakage paths through the endfaces of the respective sealing segments it is substantially minimized or eliminated. Preferably, the spline seals 64, 66 and 68 are generally rectilinear in shape as indicated by the representative example of spline seal 64 in FIG. 5.

It will be appreciated that the endface gap spline seals for the seal strip segments in accordance with the present invention may be provided as part of original equipment manufacture or retrofitted into existing machinery. For example to retrofit the spline seals, an existing steam turbine is torn down, i.e. the upper, outer and inner casings are removed and the diaphragm assemblies are removed. The seal strip segments may be removed from the diaphragm assemblies by rolling them circumferentially from the grooves. Grooves are then formed in the endfaces of the seal strip segments to receive the spline seals. With the grooves thus formed, the segments can be rolled back into the dovetail grooves of the diaphragm assemblies with the spline seals inserted in the grooves between adjacent endfaces. Alternatively, of course, new seal strip segments with the grooves already formed may be used in lieu of forming grooves in the removed seal strip segments.

Figure 6:
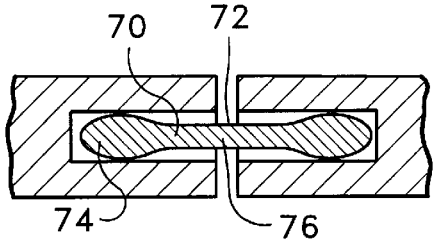
FIG. 6 is a fragmentary cross-sectional view of a further form of spline seal.

Referring now to FIG. 6, another form of spline seal 70 is illustrated in a slot or groove, for example, the groove in the circumferentially opposed endfaces of segments 36. The spline seal 70 comprises a seal body 72 with enlargements 74 along opposite edges of the seal for disposition adjacent the bases of the grooves. Thus, the central portion 76 of the seal body 72 has a reduced depth dimension in comparison with the width of the grooves. The enlargements 74 facilitate relative movement of the segments, e.g., segments 32 and 34, in an axial direction, e.g., segments 36 in a radial direction without binding or damaging the spline seal Additionally, by providing a small space between the ends of the spline seal and the ends of the slots, a slight shifting of the spline seals in the slots is accommodated, for example, in an axial direction with respect to the segments 36 and in radial directions with respect to the segments 32 and 34. The spline seals may be of the type disclosed in commonly-owned U.S. Pat. No. 5,624,227, the disclosure of which is incorporated herein by reference.

Figure 7:
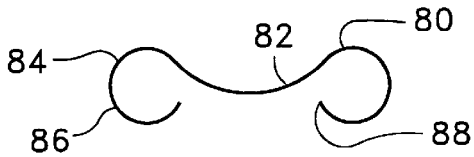
FIG. 7 is a schematic illustration of a still further form of spline seal.

Referring now to FIG. 7, another form of spline seal is illustrated. The spline seal 80 of FIG. 7 may be formed of a sheet metal material having a seal body 82 with opposite ends reversely curved or bent at 84 to form enlargements 86 along opposite sides of the spline seal 80. Edges 88 of the reversely curved portions face a central portion of the seal body 82. The enlargements 86, like the enlargements 72 of spline seal 70 of FIG. 5 are disposed adjacent the bases of the slots and facilitate relative movement of the seal strip segments 26. This type of spline seal is also disclosed in the above referenced patent.

Figure 8:
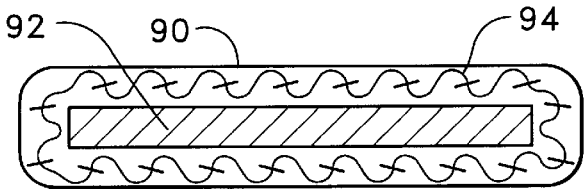
FIG. 8 is an enlarged cross-sectional view of a spline seal illustrating a metallic cloth covering therefor.

In FIG. 8 there is illustrated a spline seal 90 which may form one or more spline seals 64, 66 and 68. Spline seal 90 has a central core 92 formed of metal and having an overlay of cloth 94. The cloth layer may comprise a metal, ceramic and/or polymer fibers which have been woven to form a layer of fabric. The overlying cloth may be of the type disclosed in commonly owned U.S. Pat. No. 5,934,687, the disclosure of which is incorporated herein by reference.

It will be appreciated from the foregoing that spline seals are provided in the gaps, e.g., gaps 54, between the circumferentially registering endfaces of arcuate seal strip segments disposed in grooves of diaphragm assemblies in a steam turbine surrounding a rotor. The spline seals minimize or preclude steam leakage flow past the gaps between the end faces and between the high and low pressure regions on opposite sides of the rotating buckets. The spline seals may take the form of any one of the various forms of spline seals illustrated herein. In all cases, any steam leakage flowpaths are minimized or eliminated with resulting improvement in machine performance.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine comprising:

a rotor carrying a plurality of circumferentially spaced buckets having bucket tips;

a stationary casing surrounding the rotor and carrying a plurality of nozzles, the buckets and nozzles forming a stage of the steam turbine;

said casing carrying a plurality of circumferentially extending static seal strip segments thereabout at an axial seal location spaced radially from said bucket tips for sealing between the bucket tips and the casing;

each of said segments having endfaces respectively in circumferential registry with opposed endfaces of circumferentially adjacent segments, said endfaces including slots opening circumferentially and in general circumferential registration with one another; and a spline seal extending between each of said opposed endfaces of circumferentially adjacent segments and in said slots for minimizing or precluding steam leakage flow past said registering endfaces.

2. A turbine according to claim 1 wherein each said spline seal extends generally in axial and circumferential directions for sealing against steam leakage flows in generally radial directions.

3. A turbine according to claim 1 wherein each said spline seal extends generally in radial and circumferential directions for sealing against steam leakage flows in a generally axial direction.

4. A turbine according to claim 1 wherein each said seal strip segment has a plurality of axially spaced labyrinth seal teeth for sealing with the rotor.

5. A turbine according to claim 1 wherein said casing has a circumferentially extending groove having an axially extending hook, each said segment having a hook for radially overlying the casing hook, said casing hook and said segments having axially facing seal surfaces on a downstream side of said segment, said spline seals extending generally in axial and circumferential directions for sealing against leakage flows in generally radial directions terminating adjacent said axial facing seal surfaces.

6. A turbine according to claim 1 wherein said casing has a circumferentially extending groove having an axially extending hook, each said segment having a hook for radially overlying the casing hook, said casing hook and said segments having axially facing seal surfaces on a downstream side of said segment, said spline seals extending generally in radial and circumferential directions for sealing against leakage flows in a generally axial direction.

7. A turbine according to claim 1 wherein each said spline seal includes a cloth surrounding said spline seal along opposite sides thereof and about at least a pair of opposite edges thereof.

8. A turbine according to claim 1 wherein each said spline seal comprises a seal body having an enlargement along opposite edges and received in said slots with the enlargements adjacent bases of said slots, respectively.

9. A turbine according to claim 8 wherein said seal body is formed of sheet metal, said enlargements comprising integral bent margins of said sheet metal spline seal having edges facing central portions of said sheet metal spline.

10. A steam turbine comprising:

a rotor carrying a plurality of circumferentially spaced buckets having bucket tips;

a stationary casing surrounding the rotor carrying a plurality of nozzles, the buckets and nozzles forming a stage of the steam turbine;

said casing having a circumferentially extending dovetail-shaped groove carrying a plurality of circumferentially extending static seal strip segments thereabout in said groove, said segments carrying at least one labyrinth seal tooth for sealing about said bucket tips;

each of said segments having endfaces respectively in circumferential registry with opposed endfaces of circumferentially adjacent segments, said endfaces including slots opening circumferentially and generally in circumferential registration with one another; and a spline seal extending between each of said opposed endfaces of circumferentially adjacent segments and in said slots for minimizing or precluding steam leakage flow past said registering endfaces.

11. A turbine according to claim 10 wherein each said spline seal extends generally in axial and circumferential directions for sealing against steam leakage flows in generally radial directions.

12. A turbine according to claim 10 wherein each said spline seal extends generally in radial and circumferential directions for sealing against steam leakage flows in a generally axial direction.

13. A turbine according to claim 10 wherein said casing has a circumferentially extending groove having an axially extending hook, each said segment having a hook for radially overlying the segment hook, said casing hook and said segments having axially facing seal surfaces on downstream sides of said segments, said spline seals extending generally in axial and circumferential directions for sealing against steam leakage flows in generally radial directions.

14. A turbine according to claim 10 wherein said spline seals include a cloth surrounding each said spline seal along opposite sides thereof and about at least a pair of opposite edges thereof.

15. A turbine according to claim 10 wherein each said spline seal comprises a seal body having an enlargement along opposite edges and received in said slots with the enlargements adjacent bases of said slots, respectively.

16. A turbine according to claim 15 wherein said seal body is formed of sheet metal, said enlargements comprising integral bent margins of said sheet metal spline seal having edges facing central portions of said sheet metal spline.

17. In a steam turbine having a rotor carrying a plurality of circumferentially spaced buckets, a stationary casing surrounding the rotor and a plurality of circumferentially extending seal strip segments in circumferentially extending grooves about said casing for sealing between the casing and tips of the buckets, a method of retrofitting the seal strip segments to provide seals between the opposed endfaces of adjacent seal strip segments comprising the steps of:

removing the seal strip segments from the turbine casing;

forming at least one slot in each endface of the removed seal strip segments;

disposing a spline seal in slots of opposed endfaces of the seal strip segments; and inserting the seal strip segments into the grooves of the casing whereby the spline seals extend between adjacent segments for minimizing or precluding steam leakage flows between said adjacent segments.

18. A turbine according to claim 1 wherein each said spline seal comprises a flat metal, generally rectilinear-shaped plate, each said spline seal having a thickness of the plate less than the depth of the slots to accommodate relative movement of the segments.

19. A turbine according to claim 10 wherein each said spline seal comprises a flat metal, generally rectilinear-shaped plate, each said spline seal having a thickness of the plate less than the depth of the slots to accommodate relative movement of the segments.

* * * * *

UNITED STATES PATENT AND TRADEMARK OFFICE

CERTIFICATE OF CORRECTION

PATENT NO. : 6,722,846 B2
DATED : April 20, 2004
INVENTOR(S) : Burdgick

It is certified that error appears in the above-identified patent and that said Letters Patent is hereby corrected as shown below:

Column 6,
Line 10, delete “a spline” and insert -- a substantially non-resilient spline --.

Column 7,
Line 4, delete “a spline” and insert -- a substantially non-resilient spline --.

Column 8,
Line 15, delete “a spline” and insert -- a substantially non-resilient spline --.

Signed and Sealed this

Nineteenth Day of October, 2004

JON W. DUDAS
*Director of the United States Patent and Trademark Office*